US005510165A

United States Patent [19]

Seki

[11] Patent Number: 5,510,165

[45] Date of Patent: Apr. 23, 1996

[54] THIN FILM WRAPPING FOR CASSETTE CASE

[75] Inventor: Seizo Seki, Miyagi, Japan

[73] Assignee: Sony Corporation, Tokyo, Japan

[21] Appl. No.: 250,673

[22] Filed: May 27, 1994

Related U.S. Application Data

[63] Continuation-in-part of Ser. No. 82,721, Jun. 28, 1993, abandoned.

[30] Foreign Application Priority Data

| | | | |
|---|---|---|---|
| Jun. 30, 1992 | [JP] | Japan | 4-173393 |
| Jul. 31, 1992 | [JP] | Japan | 4-205590 |
| May 31, 1993 | [JP] | Japan | 5-129801 |

[51] Int. Cl.[6] ..... B44C 1/26

[52] U.S. Cl. ..... 426/67; 428/76; 206/497; 206/813; 206/387.1; 229/87.05; 426/413; 426/414; 426/513; 426/412

[58] Field of Search ..... 229/87.05; 206/632, 206/387, 605, 608, 633, 613, 813, 497, 387.1, 620, 631, 611; 426/412, 113, 129, 414, 513; 428/611, 67, 76, 77

[56] References Cited

U.S. PATENT DOCUMENTS

| | | | |
|---|---|---|---|
| 3,566,752 | 3/1971 | Dreher | 93/1 |
| 3,669,255 | 6/1972 | Raymus | 206/59 F |
| 4,365,716 | 12/1982 | Watt | 206/632 |
| 4,759,472 | 7/1988 | Strenger | 222/92 |
| 4,961,495 | 10/1990 | Yoshida et al. | 206/219 |
| 5,011,014 | 4/1991 | Brock et al. | 206/387 |
| 5,053,239 | 10/1991 | Vanhatalo et al. | 426/412 |
| 5,064,664 | 11/1991 | Hastad | 426/87 |
| 5,067,612 | 11/1991 | Tsuchiya et al. | 206/497 |
| 5,075,156 | 12/1991 | Tanaka et al. | 428/212 |
| 5,316,206 | 5/1994 | Tomisawa et al. | 229/87.05 |

FOREIGN PATENT DOCUMENTS

| | | |
|---|---|---|
| 2107361 | 2/1983 | United Kingdom . |
| 2123376 | 2/1984 | United Kingdom . |

*Primary Examiner*—Patrick J. Ryan
*Assistant Examiner*—Merrick Dixon
*Attorney, Agent, or Firm*—Ronald P. Kananen

[57] ABSTRACT

A partly-overlapped portion of a sheath film is meltbonded by heat to provide a seal which a user can tear open with ease. A heat sealing area of the sheath film is halftone printed to reduce the bonding area, thereby decreasing the bonding strength. A tearing portion is provided along the heat seal which is printed so that it has a bonding strength which gradually increases along the tear part until it reaches the bonding strength of the remainder of the heat seal. A curl section having minimal bonding strength relative to the tearing portion of the heat seal is induced to curl up using heat treatment to allow the user to grasp the sheath film at the tear part.

20 Claims, 15 Drawing Sheets

THIN FILM WRAPPING FOR CASSETTE CASE

CROSS-REFERENCE TO RELATED APPLICATION

The present application is a continuation-in-part of currently pending application "METHOD FOR WRAPPING UP A CASSETTE CASE IN THIN FILM", Ser. No. 08/082,721, (Attorney Docket SON-408), filed on Jun. 28, 1993, now abandoned.

BACKGROUND OF THE INVENTION

1. Field of the Invention

The present invention generally relates to a wrapping film that can tightly wrap a cassette case or the like in which a tape cassette for a video tape recorder or audio tape recorder is accommodated and, more particularly, to a wrapping film that the user can open with ease.

2. Description of the Related Art

It is customary that cassette cases are wrapped by wrapping films and then shipped so that the cassette cases may be protected from being damaged when transported or displayed on the show window or that the cassette cases may be improved in appearance (design). In the prior art, a cassette case is wrapped by a wrapping film as follows.

As shown in FIG. 1 of the accompanying drawings, a wrapping film 21 made of a polypropylene (PP) is provided in a roll shape and cut to have a predetermined length a. Then, as shown in FIG. 2, a cassette case is wrapped by the wrapping film 21 and partly overlapping portions are bonded (i.e., heat-sealed) to hold the cassette case in a sealed condition. As illustrated, there are provided a center sealing surface 22 and a side sealing surface 23, respectively. End edge portions of the center sealing surface 22 and the side sealing surface 23 are served as sealing areas 22*a*, 23*a*, respectively. While it is customary that the wrapping film 21 is wholly printed in color, the sealing areas 22*a*, 23*a* are not applied with inks. Accordingly, when the sealing areas 22*a*, 23*a* are heated under the condition that the cassette case is wrapped by the wrapping film 21, the wrapping film 21 made of polypropylene is melt-bonded to heat-seal the wrapping film 21.

The product in which the cassette case is wrapped by the polypropylene wrapping film 21 and tightly sealed by the heat seal has a V-shaped notch 24 formed at one portion of the bonding portion on the center sealing surface 22 as shown in FIG. 2. The user can catch the notch 24 with a fingernail to tear the wrapping film 21 from the product.

FIGS. 3A and 3B show another example of the conventional wrapping film 21 having a so-called tearing strip 25 extended along the inner periphery of the wrapping film 21. The tearing strip 25 is interposed between the cassette case and the wrapping film 21 and wound around the outer periphery of the cassette case. One end of the tearing strip 25 is projected from the wrapping film winding end as a tab portion. The wrapping film 21 has slits formed at both sides of the tearing strip 25 so that the user can tear the wrapping film 21 along the tearing strip 25. Therefore, the user can hold the tab portion and tear the wrapping film 21 along the slits to open the wrapped film 21.

In the former wrapping film 21 having the V-shaped notch 24 formed at the bonding portion on the center sealing surface 22, the bonding portion has a large bonding strength so that the user cannot tear the wrapping film 21 from the center sealing surface 22 with ease. Thus, it is cumbersome for the user to open the wrapping film 21.

The latter wrapping film 21 having the tearing strip 25 also cannot avoid the following disadvantage. That is, if the user tears the wrapping film 21 along only the tearing strip 25 as shown in FIG. 3B, then the user cannot substantially tear the remaining wrapping film 21 even with a fingernail. Therefore, the wrapping film 21 is very difficult to be opened.

In addition, the tear strip is easily torn in the wrong direction if not drawn out with care, leaving behind the wrapping film which is difficult to remove.

The tearing strip 25 is made of a material whose tear propagation resistance is higher than that of the wrapping film 21, By way of example, the tearing strip 25 is formed by bonding two kinds of transparent plastic films. When the tearing strip 25 is formed as a color tearing strip, the surface of one film material is printed and then bonded to the other film material.

The cassette case as a wrapped product is wrapped by the wrapping film made of the aforesaid material when the two films are melt-bonded to each other by the heat treatment of the wrapping film. However, since the surface of the cassette case is tightly wrapped by the wrapping film by heating the wrapping film at temperature higher than necessary in order to improve the appearance of the cassette case after the cassette case was packaged, the tab portion of the tearing strip also is bonded to the melt-bonded portion of the wrapping film. There are then the problems that the user cannot find the tab portion of the tearing strip without difficulty and that the user cannot tear the tab portion without difficulty. Particularly, when the user wants to supplement tapes in order to record sound or picture in a hurry, the user cannot open the wrapping film readily. There is then the problem that the user misses the opportunity to effect such recording.

Recently, instead of using a tear strip, the sealed wrapping film section was provided with an unsealed part which may be peeled open by the user. The user can encounter difficulty in finding the unsealed part along the sealed case. Further inconvenience for the user occurs due to the difficulties encountered when fingernails are used. For instance, numerous scrapings of the unsealed part may be required to peel open the unsealed part.

OBJECTS AND SUMMARY OF THE INVENTION

Therefore, it is a general object of the present invention to provide a case for accommodating therein a data storage or recording medium cartridge in which the aforesaid shortcomings and disadvantages encountered with the prior art can be eliminated.

More specifically, it is an object of the present invention to provide an improved wrapping film for wrapping a case that accommodates therein a data storage or recording medium cartridge and in which the aforesaid shortcomings and disadvantages of the prior art can be eliminated.

It is another object of the present invention to provide a wrapping film in which a wrapping film can be opened reliably and readily when the user tears the wrapping film.

It is a further object of the present invention to provide a wrapping method in which a wrapping film can be torn from a bonding portion with ease and removed when the user opens the wrapping film.

According to a first aspect of the present invention, there is provided a case for accommodating therein a data storage or recording medium cartridge which comprises a wrapping film having a heat sealing area and a printing area which are bonded together by heat and wrapping the case, and a tearing strip wound around an outer periphery of the case for tearing the wrapping film, wherein one end of the tearing strip has a tab portion projected from the heat sealing area, and at least either the other side of the tab portion or the wrapping film portion opposed to the position of the other side of the tab portion is formed as a low adhesion portion which is bonded at a bonding strength smaller than that of the heat sealed portion.

According to a second aspect of the present invention, there is provided a wrapping film for wrapping a case that accommodates therein a data storage or recording medium cartridge which comprises heat sealing areas put one on the other when the case is wrapped and bonded by heat, a printing area on which decorations are printed, and a device for tearing the wrapping film, wherein the entirety of the heat sealing areas is treated by a process so that a bonding area is reduced substantially uniformly.

According to the wrapping film of the present invention, since the low adhesion portion is formed on at least either the other side of the tab portion of the tearing strip or on the wrapping film surface to which the other side of the tab portion is opposed, the tab portion can be prevented from being bonded to the wrapping film surface when the wrapping film is melt-bonded. As a consequence, the user can hold the tab portion with ease and therefore open the wrapping film reliably and readily.

Furthermore, since the bonding strength of the heat sealing portion is decreased, the user can tear the wrapping film from the bonding portion with ease and open the wrapping film easily.

According to another aspect of this invention, there is provided a packaging film for wrapping a case having a tearing portion along the heat sealing area which gradually increases in bonding strength. A peel section area having a weak bonding strength relative to the tearing portion of the heat sealing area is provided which curls when the film is shrunk by heat. Cut tape may be avoided, thus, the external appearance is good and production ease is increased. Costs may also be decreased.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Embodiments of the wrapping film according to the present invention will now be described with reference to the drawings.

Figure 4:
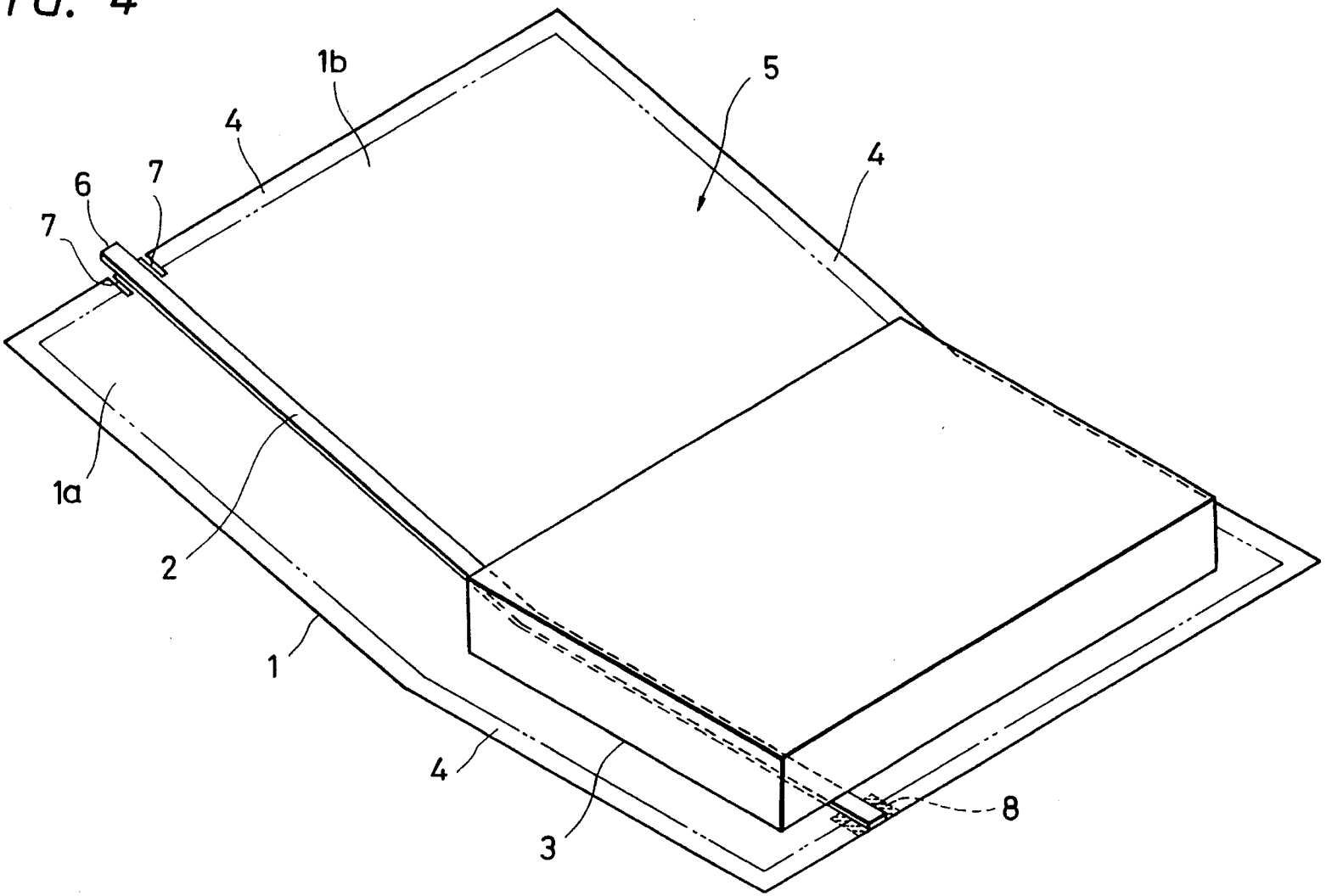
FIG. 4 is a perspective view of a wrapping film according to a first embodiment of the present invention and illustrating the condition that the wrapping film is in the expanded state.

As shown in FIG. 4, a wrapping film according to a first embodiment of the present invention is composed of a thin film-shaped wrapping film 1 made of heat-shrinkable polypropylene and a film strip formed by bonding two kinds of plastic films which are colored and harder than the wrapping film 1 to be torn. This film strip is an adhesive tearing strip 2 having a nonductile property. An outer peripheral edge of the wrapping film 1 is served as a melt-bonding portion 4 that is used to wrap a cassette case 3 in which there is accommodated a tape cassette which is a wrapped product. Most of the wrapping film 1 surface except the meltbonding portion 4 is served as a printing surface 5 which is printed in a predetermined manner so as to show explanations on the accommodated tape cassette product.

The tearing strip 2 is bonded to the wrapping film 1 by a melt-bonding property of the non-ductile film. When the cassette case 3 is wrapped by the wrapping film 1, the tearing strip 2 is interposed between the wrapping film 1 and the cassette case 3 and the cassette case 3 is wrapped at the portion near one end thereof. Therefore, the wrapping film 1 can be divided by the tearing strip 2 serving as a border line into a first wrapping film portion la that wraps one end of the cassette case 3 and a second wrapping film portion 1*b* that wraps most of the other end portion of the cassette case 3.

One end portion of the tearing strip 2 forms a tab portion 6 that is projected from the end portion of the wrapping film 1 by a predetermined length to thereby enable the user to tear and open the wrapping film 1. The wrapping film 1 has at its respective portions of the tab portion 6 notches 7, 7 of predetermined lengths which are serving as guide portions used when the user tears the wrapping film 1.

Figure 5:
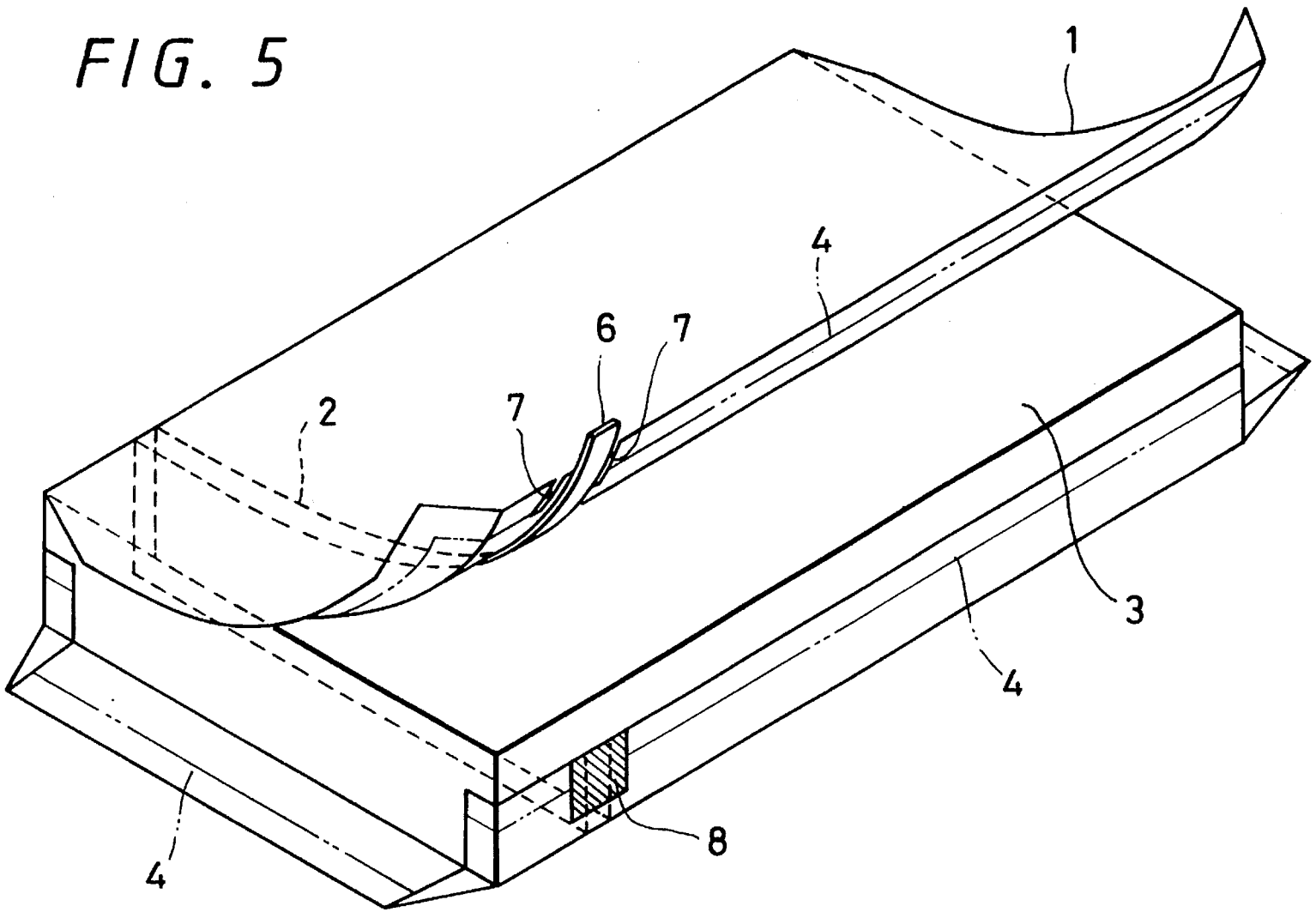
FIG. 5 is a perspective view of the same wrapping film during a cassette case is being wrapped by the wrapping film.
Figure 6:
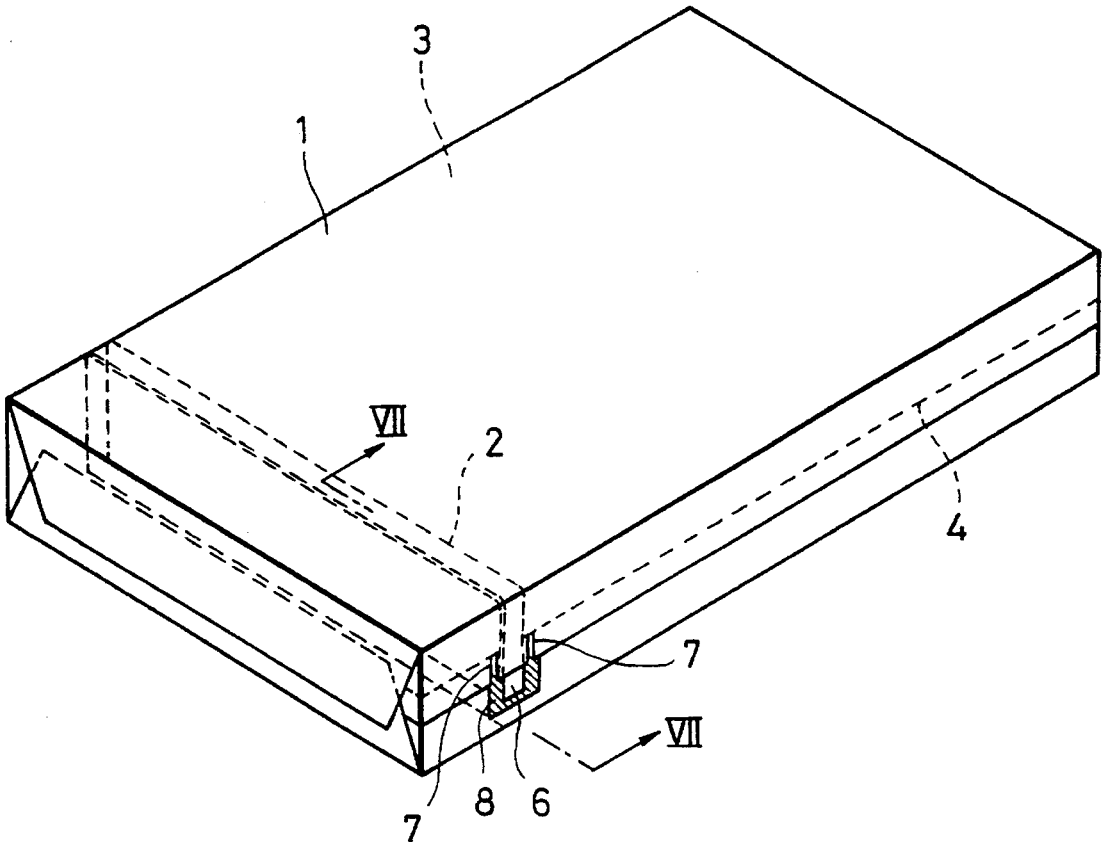
FIG. 6 is a perspective view of the same wrapping film and illustrating the condition that the cassette case is wrapped by the wrapping film.

The surface of the wrapping film 1 to which the other end portion of the tearing strip 2 is bonded is printed by some suitable surface printing process such as gravure printing or the like to form a low adhesion portion 8 in which the tab portion 6 can be prevented from being melt-bonded on the wrapping film 1 at this portion. That is, the cassette case 3 is wrapped by the wrapping film 1 as shown in FIG. 5 and the cassette case 3 is finally wrapped by the wrapping film 1. Then, as shown in FIG. 6, when the melt-bonding portion 4 is melt-bonded by the heat-seal treatment and the cassette case 3 is tightly wrapped by the wrapping film 1, the tab portion 6 of the tearing strip 2 and the nearby tearing strip portion are overlapped onto the surface of the low adhesion portion 8.

Figure 7:
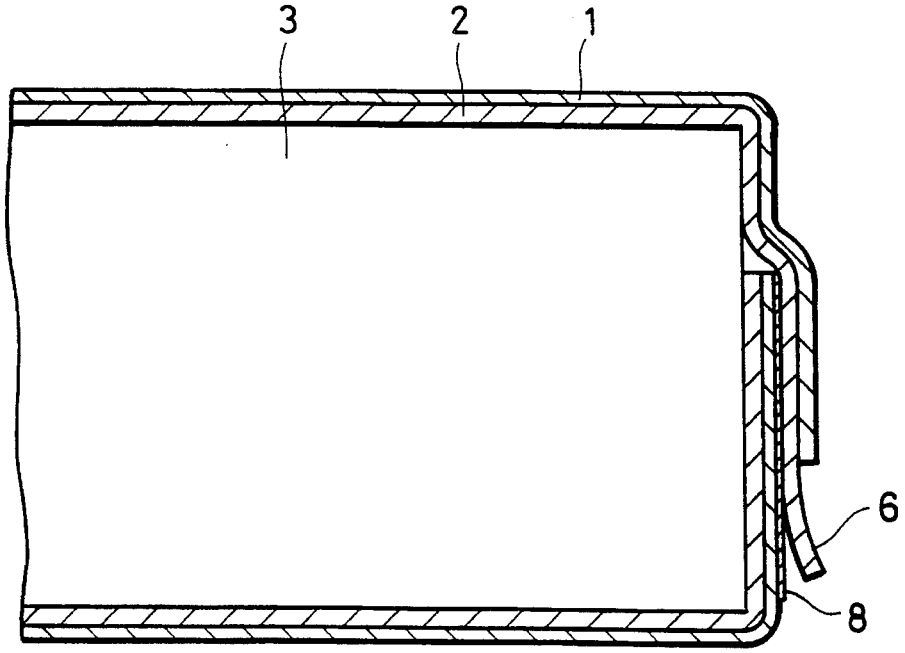
FIG. 7 is an enlarged cross-sectional view taken through the line VII—VII in FIG. 6.

Therefore, even if the overlapped wrapping end of the wrapping film 1 that wraps the cassette case 3 is melt-bonded at the melt-bonding portion 4 by the heat-seal process at excessively high temperature, the tab portion 6 of the tearing strip 2 can be prevented from being bonded in the melt-bonding portion 4 opposed to the tab portion 6 of the tearing strip 2 because the low adhesion portion 8 is formed, as shown in FIG. 7 in an enlarged scale. Thus, the user can hold the tab portion 6 with ease.

A second embodiment of the present invention will be described below with reference to FIGS. 8 to 10.

Figure 8:
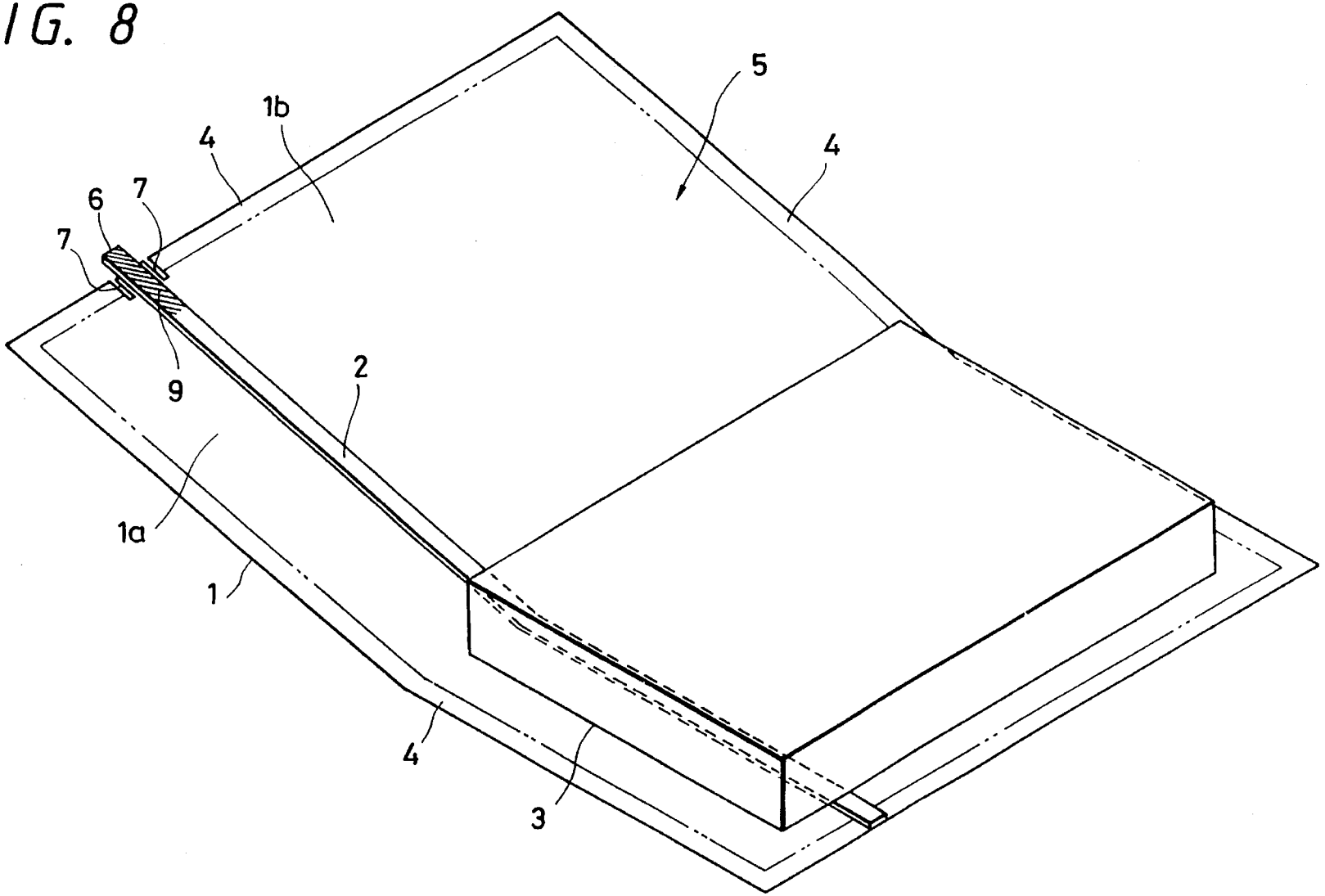
FIG. 8 is a perspective view of a wrapping film according to a second embodiment of the present invention and illustrating the condition that the wrapping film is in the expanded state.
Figure 9:
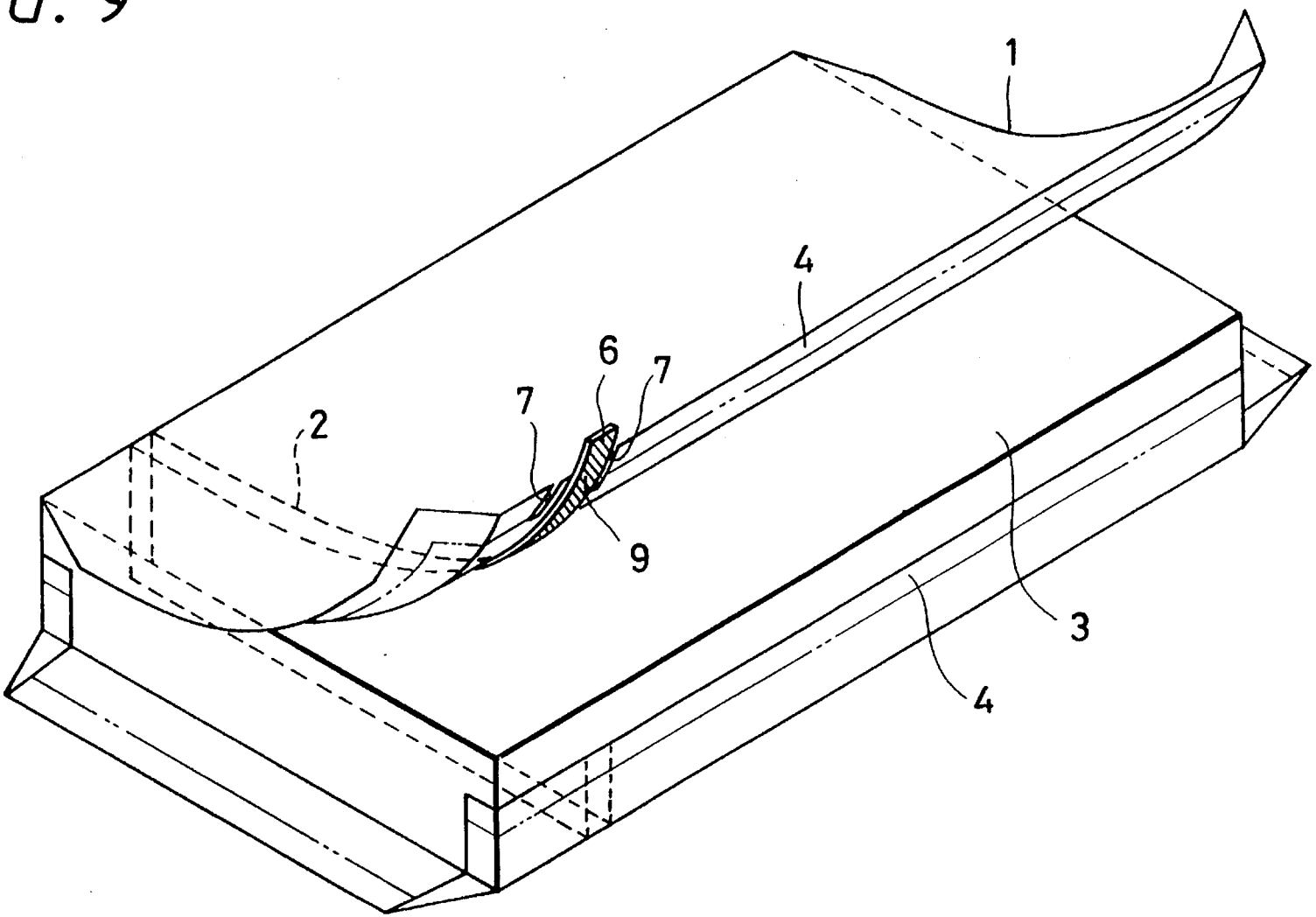
FIG. 9 is a perspective view of the same wrapping film during a cassette case is being wrapped by this wrapping film.
Figure 10:
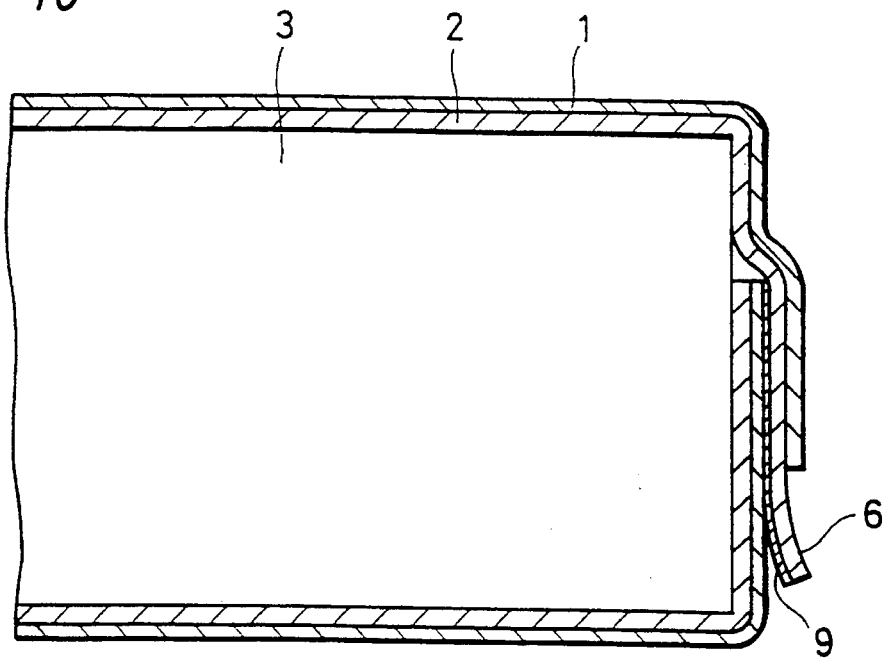
FIG. 10 is a cross-sectional view illustrating the same wrapping film in an enlarged scale under the condition that the cassette case is wrapped by this wrapping film.

In a wrapping film of the second embodiment of the present invention, a low adhesion portion 9 is formed by printing the surface of the tab portion 6 and the surface portion of the nearby tearing strip 2 according to some suitable surface printing process such as a gravure printing or the like as shown in FIGS. 8 and 9. Therefore, according to the thus arranged wrapping film, even if the overlapped winding end of the wrapping film 1 that wraps the cassette case 3 is melt-bonded at the meltbonding portion 4 by the heat-seal process at temperature higher than necessary, as shown in FIG. 10, the tab portion 6 of the tearing strip 2 can be prevented from being bonded to the opposing melt-bonding portion 4. Thus, the user can hold the tab portion 6 with ease similarly to the aforesaid embodiments.

A third embodiment of the present invention will be described below.

Figure 12:
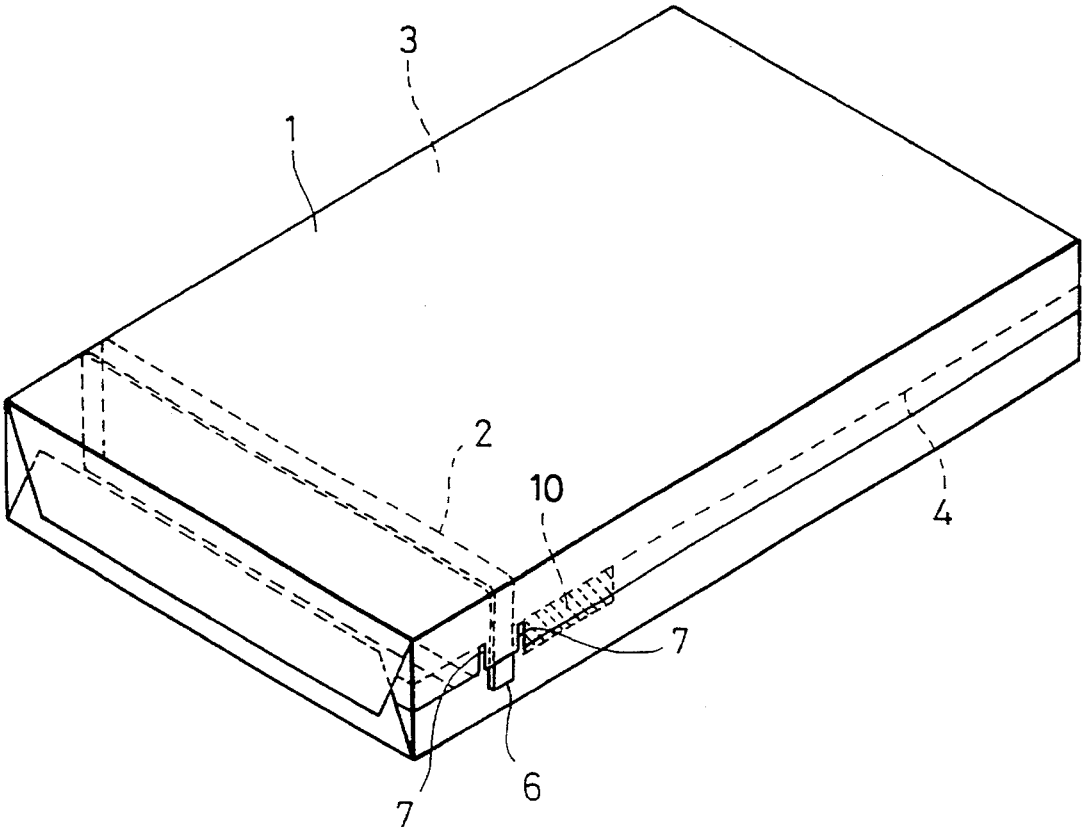
FIG. 12 is a perspective view of the same wrapping film and illustrating the condition that the cassette case is wrapped by the wrapping film.
Figure 11:
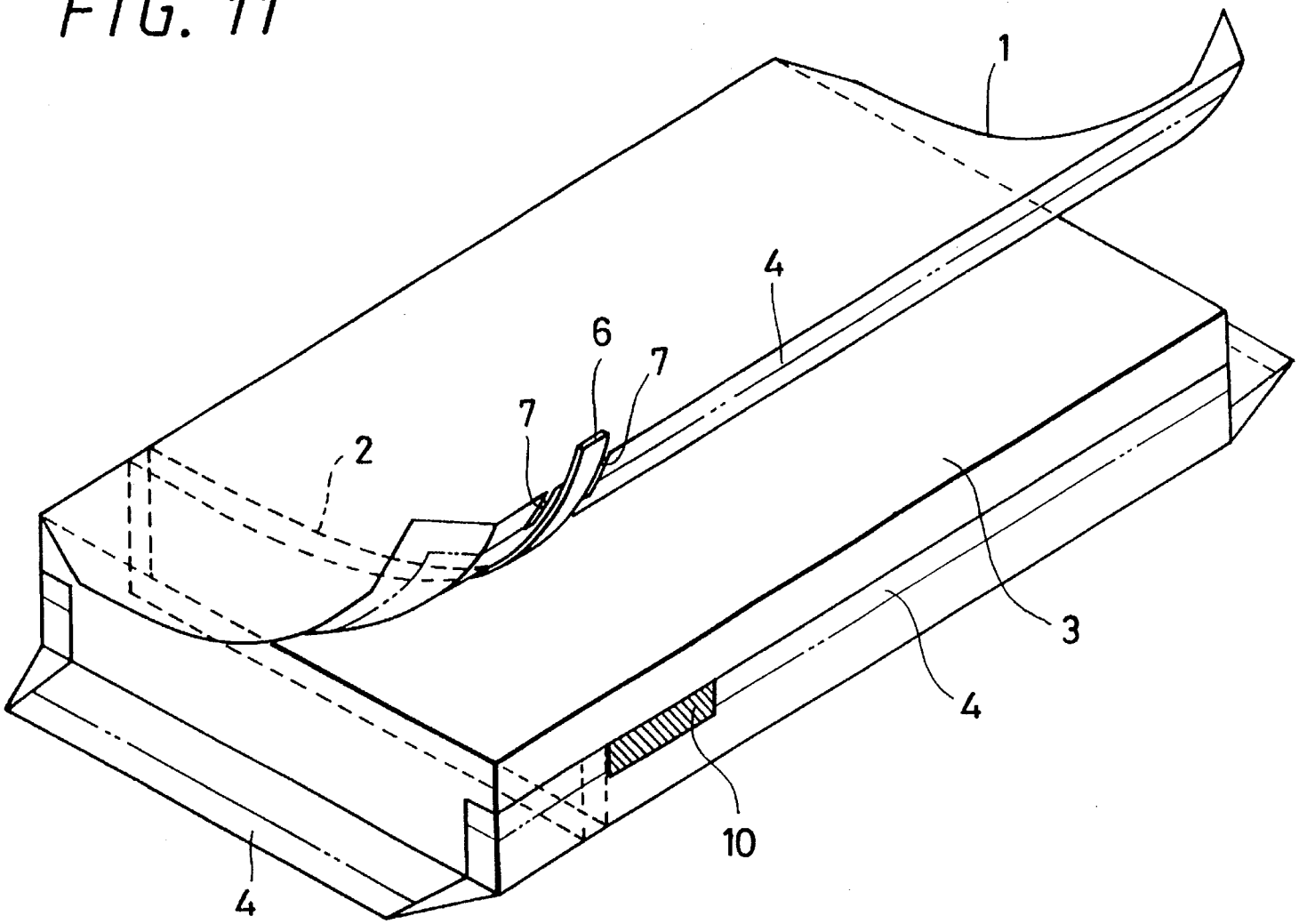
FIG. 11 is a perspective view of a wrapping film according to a third embodiment of the present invention and illustrating the condition that the cassette case is being wrapped by the wrapping film.
Figure 13:
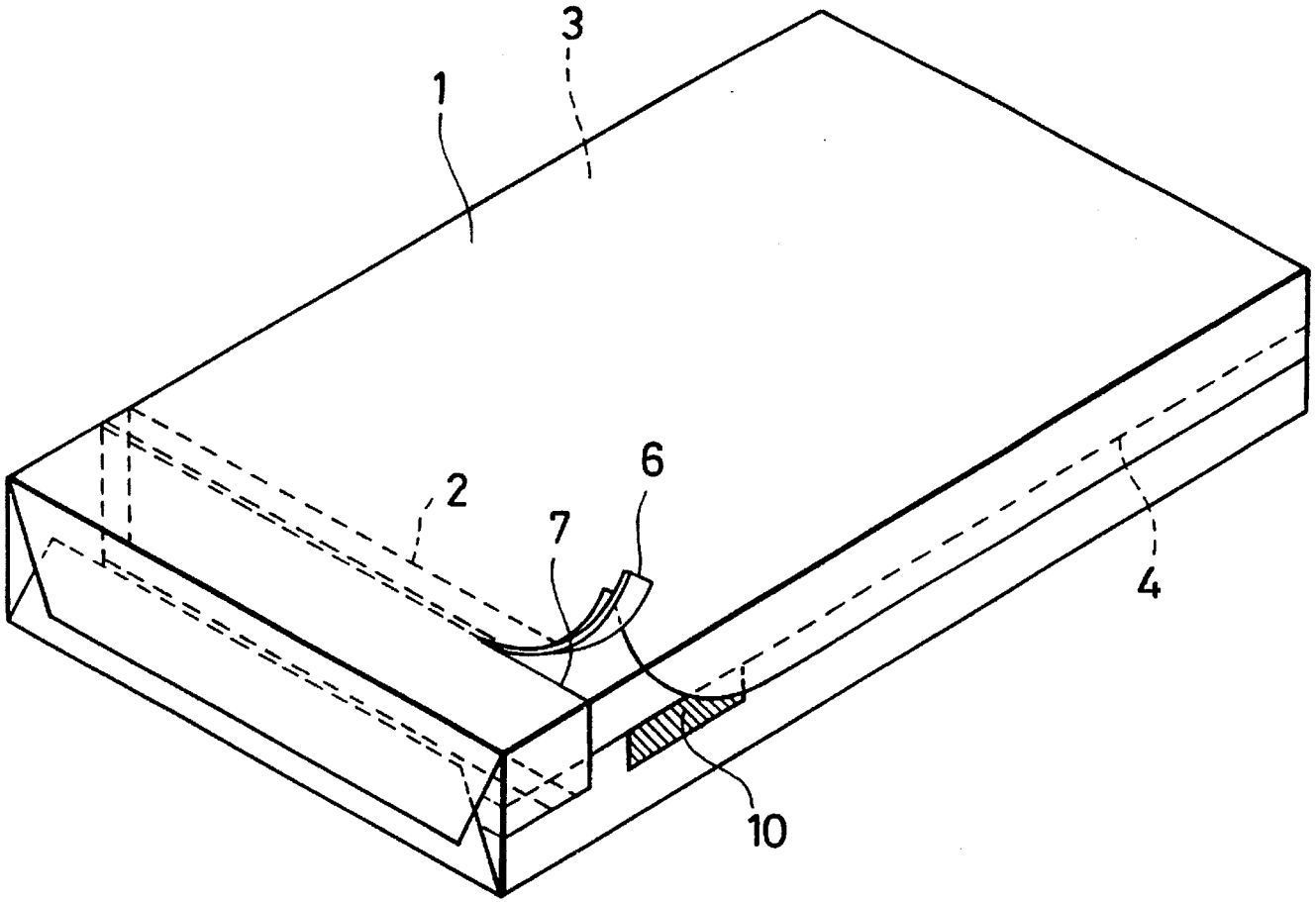
FIG. 13 is a perspective view of the same wrapping film and illustrating the condition that the wrapping film is being opened.

In the wrapping film of this embodiment, as shown in FIGS. 11 and 12, the melt-bonding portion 4 is printed at the wrapping film 1 side opposing the tab portion 6 of the tearing strip 2 and the larger wrapping film adjacent to the tab portion 6 in a predetermine range (e.g., 20 to 30 mm) to thereby form a low adhesion portion 10 to which the wrapping film is difficult to be bonded. According to this wrapping film, even when the wrapping film 1 that wraps the cassette case 3 has its overlapped winding ends melt-bonded to the melt-bonding portion 4 by the heat-seal process at temperature higher than necessary, the wrapping film portion of the low adhesion portion 10 is decreased in melt-bonding force. Since the low adhesion portion 10 is formed so that, when the user holds the tab portion 6 of the tearing strip 2 to open the wrapping film as shown in FIG. 13. the wrapping film 1 can be torn by the notch 7 and that the wrapping film portion opposing the low adhesion portion 10 can be torn with ease. Therefore, the user can readily and reliably open the wrapping film of larger film area which had imposed a cumbersome work on the user to open the wrapping film.

The aforesaid low adhesion portion 10 might be a complete non-adhesive portion. In that case, under the product condition that the cassette case is wrapped by the wrapping film, it is frequently observed that the wrapping film of the low adhesion portion 10 is torn or the wrapping film is torn off from that portion unnecessarily, bringing about inferior products.

Figure 14:
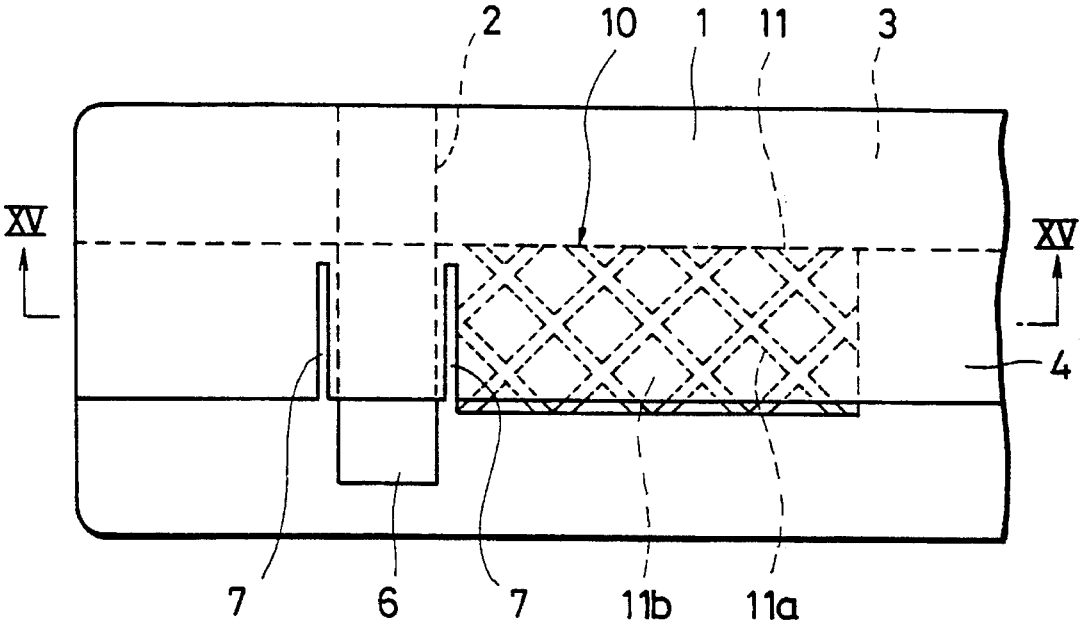
FIG. 14 is a front view illustrating an example of a low adhesion portion of the same wrapping film concretely in an enlarged scale.
Figure 15:
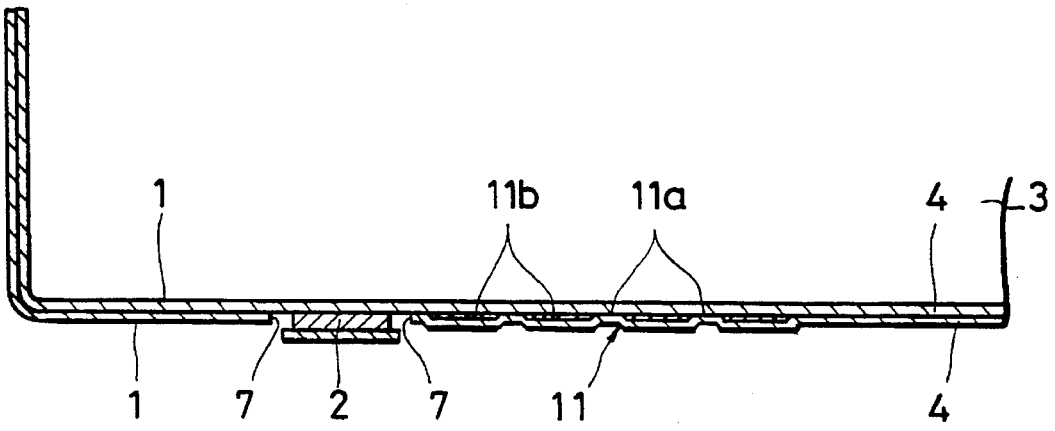
FIG. 15 is a cross-sectional view taken through the line XV—XV in FIG. 14.

A halftone printing portion 11 shown in FIGS. 14 and 15 is provided as a concrete example of the low adhesion portion 10. The halftone printing portion 11 is composed of halftone non-printing surfaces 11*a* of thin strip and printing surfaces 11*b* that occupy most of the remaining portion of the halftone printing portion 11. Under the condition that the cassette case 3 is sealed by the halftone printing portion 11, the overlapped surface of the wrapping film 1 is partly meltbonded so that the wrapping film 1, provided as the wrapped product, can be prevented from being torn off unnecessarily. In addition, when the user holds the tab portion 6 of the tearing strip 2 to open the wrapping film 1, the melt-bonding portion 4 of the halftone printing portion 11 can be torn with ease. In this embodiment, since the other side of the tab portion 6 is not printed at all, the other side of the tab portion 6 is frequently bonded to the opposing surface of the wrapping film 1 by the heat-seal treatment. Therefore, the other side of the tab portion 6 must be prevented from being bonded to the surface of the wrapping film 1 by printing the other side of the tab portion 6.

A fourth embodiment of the present invention will be described with reference to FIG. 16 and FIGS. 17A, 17B.

Figure 1:
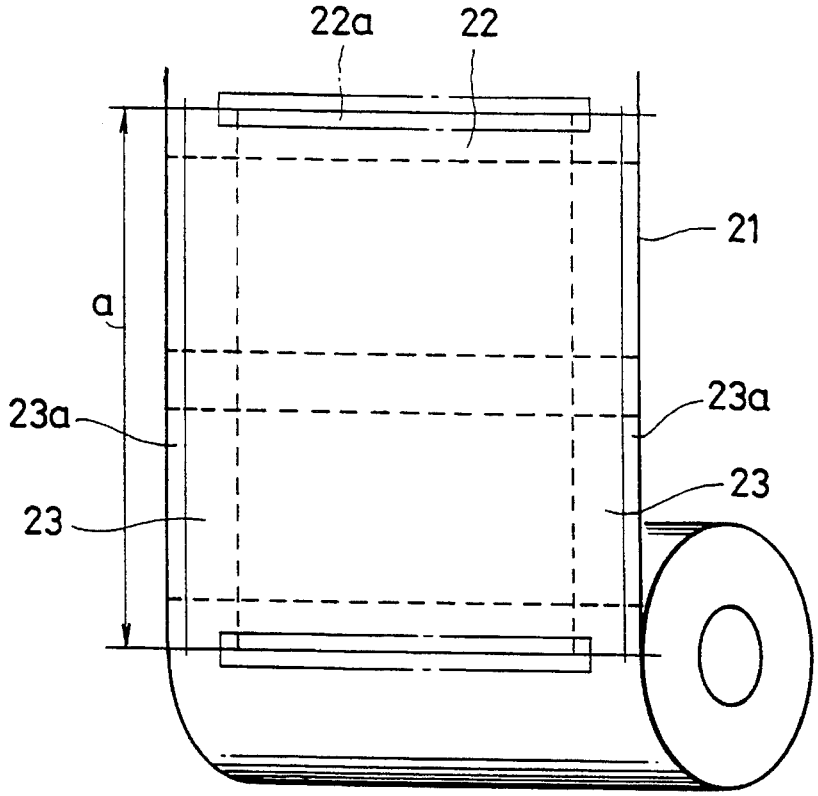
FIG. 1 (PRIOR ART)
FIG. 1 is a diagram used to explain a conventional wrapping film.
Figure 2:
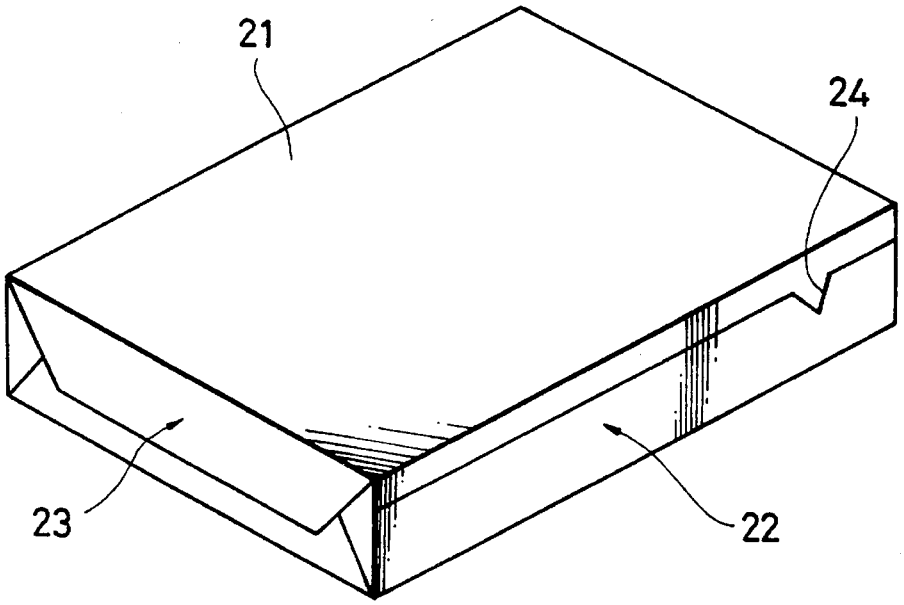
FIG. 2 (PRIOR ART)
FIG. 2 is a perspective view illustrative of an example of a conventional wrapping film having no tearing strip.
Figure 16:
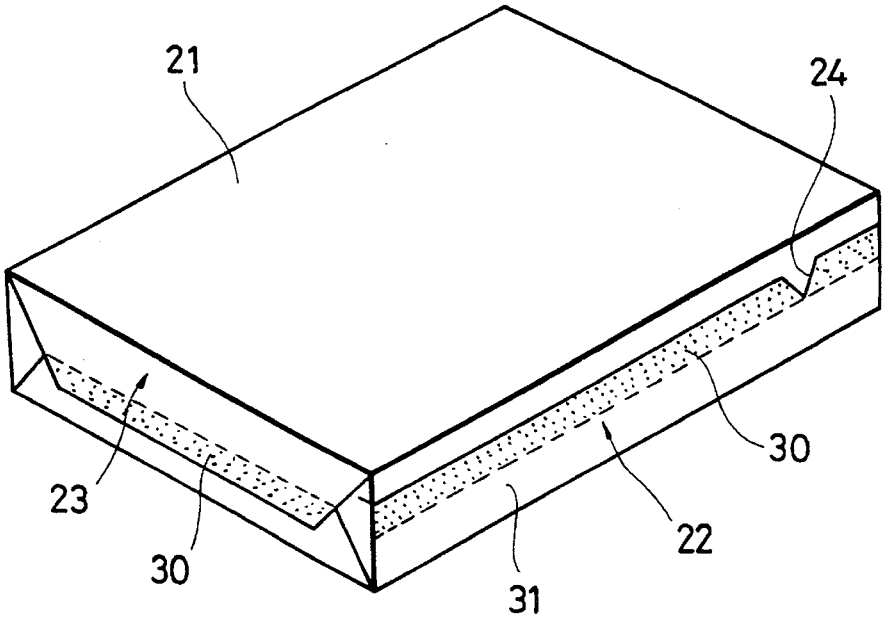
FIG. 16 is a perspective view of a wrapping film according to a fourth embodiment of the present invention.
Figure 17A:
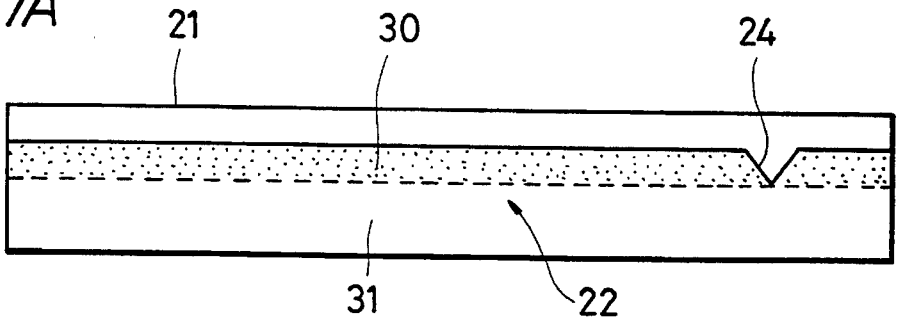
FIGS. 17A and 17B are side views of the same wrapping film, respectively.
Figure 17B:
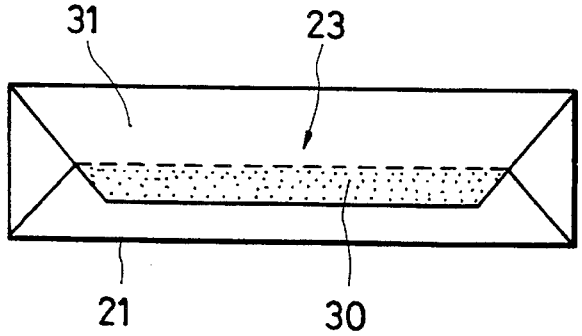

As shown in FIG. 16 and FIGS. 17A, 17B, a so-called halftone printing portion 30 is printed on the entirety of the respective bonding portions (melt-bonding surfaces by heat, i.e., sealing areas 22*a*, 23*a* shown in FIG. 1) of the center sealing surface 22 and the side sealing surface 23 of the wrapping film 1. The portion 31 than the above halftone printing portion 30 is printed wholly in an ordinary printing manner. The halftone is printed on the melt-bonding portion of the wrapping film 21 so that, when the wrapping film 21 is melt-bonded by heat, the printing portion is not melt-bonded and the portion that is not printed is melt-bonded in a dot pattern. As a result, the whole bonding area is decreased substantially uniformly, decreasing a bonding strength more as compared with the prior art. Thus, the wrapping film 21 can be torn from the notch 24 of the center sealing surface 23 with ease.

Figure 18:
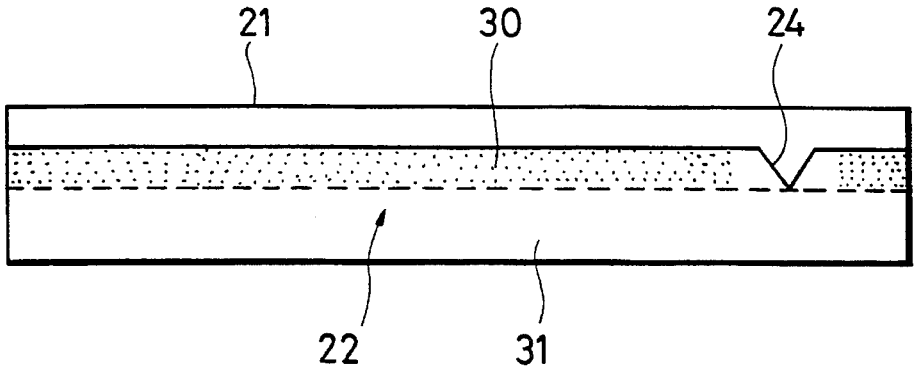
FIG. 18 is a perspective view of a wrapping film according to a fifth embodiment of the present invention.

A fifth embodiment of the present invention will be described below with reference to FIG. 18. FIG. 18 shows a modified example of the fourth embodiment shown in FIG. 16 and FIGS. 17A, 17B. In this embodiment, the bonding portion is printed only at its one portion near the notch 24 in a whole printing fashion unlike the halftone printing portion 30, i.e., such portion is formed as the portion that cannot be melt-bonded even when heated, Therefore, when the user opens the wrapping film, the user can hold the notch 24 with the fingernail with ease.

Figure 3A:
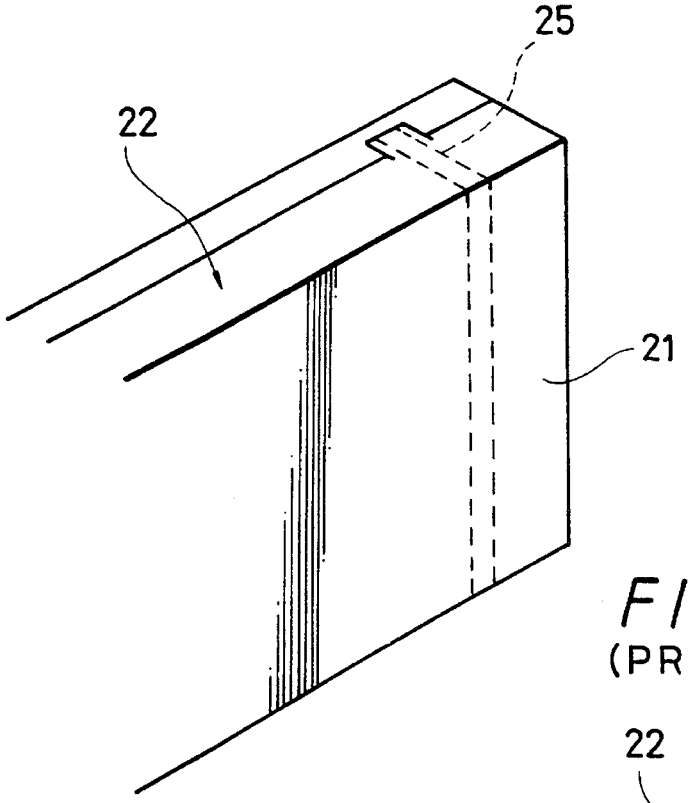
FIG. 3A (PRIOR ART)
FIGS. 3A and 3B are perspective views illustrative of an example of a conventional wrapping film having a tearing strip, respectively.
Figure 3B:
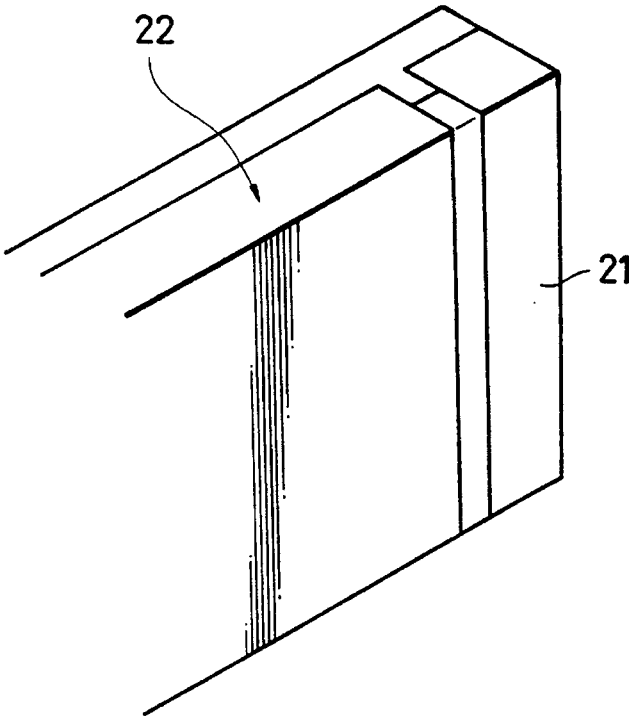
FIG. 3B (PRIOR ART)
Figure 19:
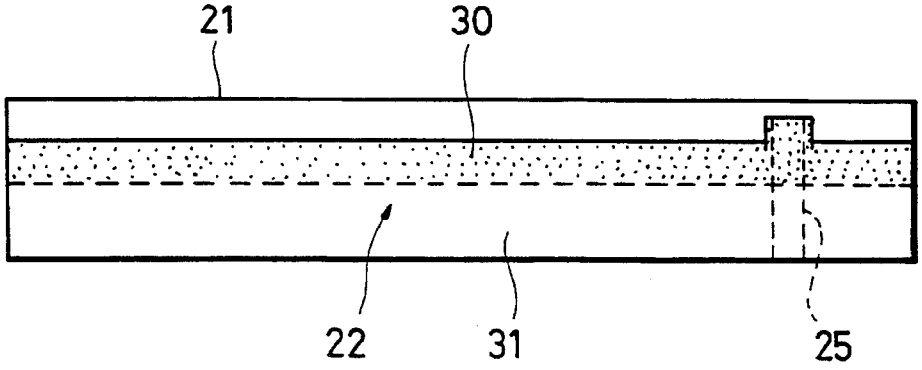
FIG. 19 is a side view of a wrapping film according to a sixth embodiment of the present invention.

FIG. 19 shows a wrapping film having the tearing strip 25 according to a sixth embodiment of the present invention. Even when the tearing strip 25 is torn as shown in FIG. 3B, the user can tear the wrapping film 21 from the bonding portion one more time because the bonding strength of the bonding portion is decreased by the halftone printing.

Figure 20:
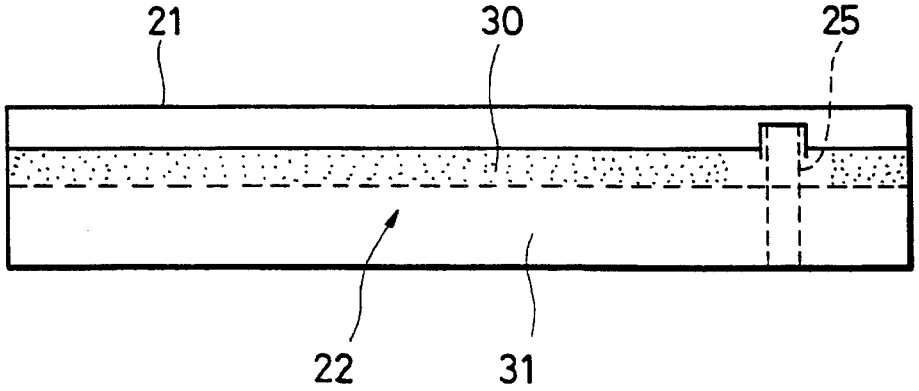
FIG. 20 is a side view of a wrapping film according to a seventh embodiment of the present invention.

A seventh embodiment of the present invention will be described with reference to FIG. 20. In the wrapping film 21 having the tearing strip 25, if the bonding portion is changed at its one portion near the tearing strip 25 from the halftone printing portion 30 to the whole printed portion, then the user can open the wrapping film more easily.

The low adhesion portions 8, 9 in the wrapping films of the first and second embodiments are not limited to the whole surface printing such as a gravure printing or the like and may be formed by the halftone printing as in the third embodiment. Further, other methods may be employed so long as similar action, achieved by the halftone printing, can be achieved.

While the tearing strip 2 is bonded to the wrapping film 1 by means of adhesion of non-ductile polypropylene as described above, the present invention is not limited thereto and the tearing strip 2 may be melt-bonded to the wrapping film 1 by other method such as hot-melt or the like. While the wrapping film of the present invention is used to tightly wrap the cassette case in which the tape cassette is accommodated or the like as described above, the present invention is not limited thereto and the wrapping film of the present invention may be applied to a wide variety of wrapping films for the wrapped products.

According to the present invention, a bonding strength can be arbitrarily set by changing a size of halftone printing. Further, while the bonding area of the bonding portion is uniformly reduced by the halftone printing as described above, the present invention is not limited to such halftone printing and other printing pattern (e.g., stripe pattern) may be used.

As set out above, according to the present invention, there is provided the wrapping film that tightly wraps the wrapped product and in which the user can open the wrapping film by holding the tearing strip having the tab portion. In this wrapping film, the low adhesion portion is formed on either the other side of the tab portion of the tearing strip or on the wrapping film surface to which the other side of the tab portion is opposed so that, when the wrapped product is wrapped and then sealed by the wrapping film, the tab portion of the tearing strip can be prevented from being melt-bonded to the wrapping film surface. Therefore, the user can hold the tab portion with ease to open the wrapping film reliably and readily.

Furthermore, there is provided a wrapping method in which a wrapped product is wrapped by a wrapping film and the overlapping portions of the wrapping film are sealed by heat seal treatment. In this wrapping method, the heat seal portion is printed by some suitable printing method such as halftone printing or the like that can uniformly reduce the bonding area of the whole bonding portion and the bonding strength can be decreased. Therefore, when the user opens the wrapping film, the wrapping film can be peeled from the bonding portion with ease and removed. Particularly, a wrapping film on which a picture is wholly printed can be provided as the wrapping film of the present invention inexpensively by forming one portion thereof as a halftone printing.

An eighth embodiment of the present invention will now be described with respect to FIGS. 21 and 22.

Figure 21:
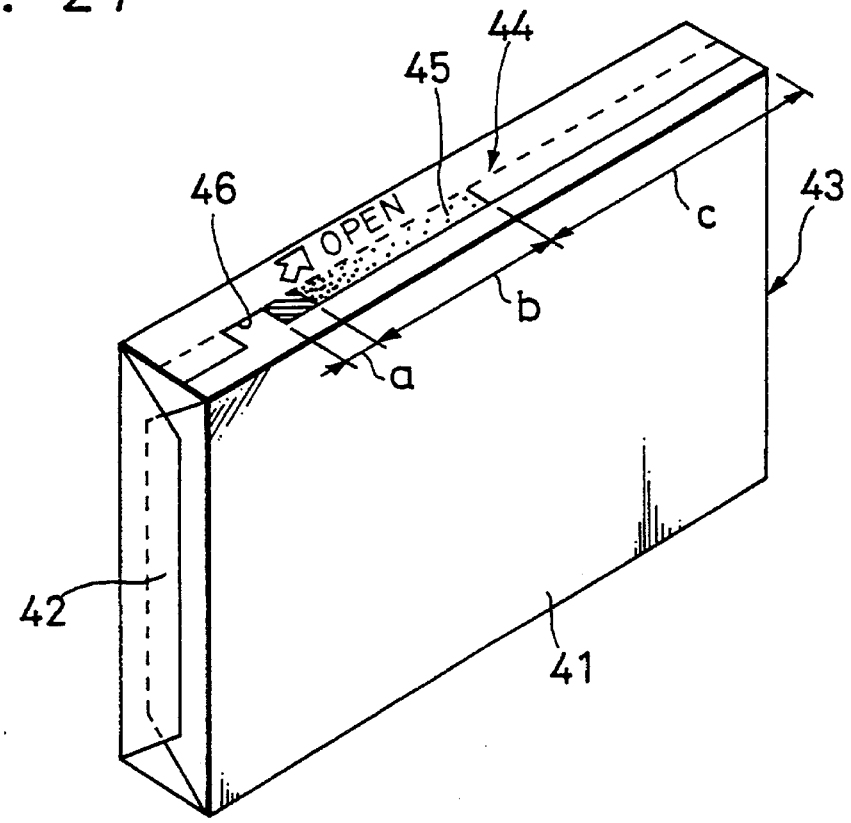
FIG. 21 is a perspective view of a wrapping film according to an eighth embodiment of the present invention illustrating the tearing portion of the wrapping film having regions of varying bonding strength.

As shown in FIG. 21, a packaging film 41 is wrapped around a box-shaped object, not shown, such as, a tape cassette case measuring 110×70×17 mm. The packaging film 41 consists of a heat-shrinkable polypropylene which becomes transparent at 120 to 130 degrees C°. The portions of the film overlap on sides 42, 43, and 44 in heat sealable areas. These overlapping portions have heat applied to them which melts and bonds the overlapped portions of the film.

Figure 23:
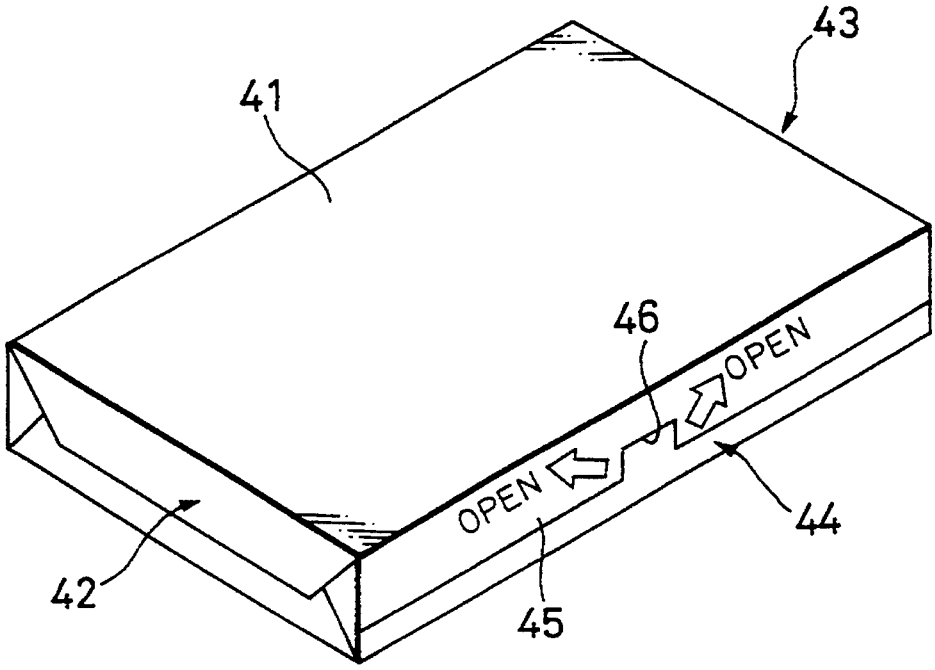
FIG. 23 is a perspective view of a wrapping film according to a ninth embodiment of the present invention.
Figure 24:
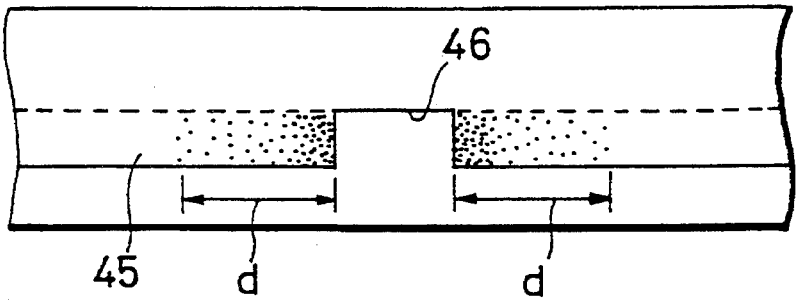
FIG. 24 is a side view in enlarged form showing the tearing portion of the wrapping film according to the ninth embodiment.

Along one side of the tape cassette case in this example, a tear off notch section 46 separates a heat sealing area 45. Moreover, the packaging film has a section (a) for peeling, a section (b) for tearing along the heat seal area, and a section (c) corresponding to the remainder of the heat sealing area. The tear off notch section 46 is provided closer to one end of the cassette case, as shown in FIGS. 21 and 22, to allow a large part of the film material to be torn. Alternatively, the tear off notch section 46 may be provided toward the center of the case as shown in FIGS. 23 and 24 to allow tearing in two directions, left or right.

The bonding strength for these sections a, b, and c of the packaging film varies. Section (a), located closest to the tear off notch section 46, may be 5 mm. long and has a bonding strength of almost zero. Section (b) has a range of 35 mm. and has a bonding strength which gradually increases from a weak to strong adhesion. Section (c) has a strong, normal adhesion.

Printing is used to vary the bonding strength or adhesion of the heat sealed area. In general, since heat is applied to the polypropylene (PP) film, if printing is performed on the adhesion surface, in other words, if ink remains, then bonding becomes more difficult. Thus, the darker the printing on the film, that is the greater the density of ink dots covering the film surface, the weaker the bonding strength between overlapping surfaces of the film material at the heat sealing area will be.

Figure 22:
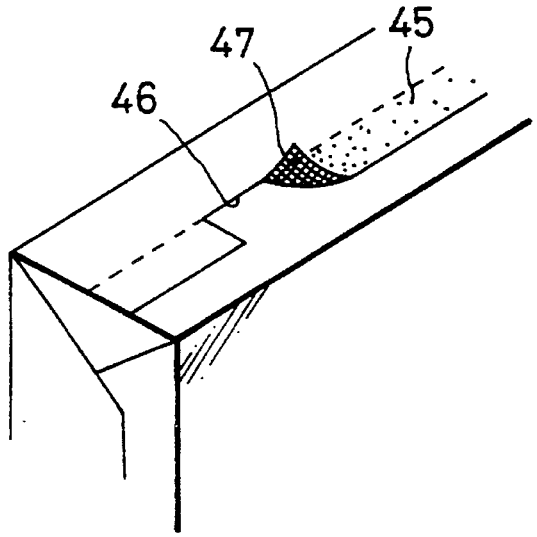
FIG. 22 is an enlarged form of the same perspective view of FIG. 21 illustrating the curling of a peel section.

In the example of FIGS. 21 and 22, the surface of the film in section (a) is solidly printed at a substantially 100% dot density. The surface of section (b) has dot printing which, starting at the end nearest the tear off notch section 46, has a graduated dot density ranging from 60% to almost 0% near section (c). No printing is performed on the surface of section (c). The printing of heat sealing area 45 may be performed at the same time as the printing of designs is performed on the rest of the clear packaging film. With this type of printing, applying heat results in almost no bonding at section (a), gradually increased bonding strength along section (b), and a complete, firm bond at section (c).

As shown in FIG. 22, in a heat process, such as, when the packaging film as wrapped around a cassette case and passed through a heat shrink tunnel, the film at the almost unbonded section (a) which neighbors tear off notch section 46, will curl up to form a curl section 47 which is easy to locate and grasp. The curl section 47 can be easily torn in the direction of the "OPEN" arrow, since the bonding strength of the film material in the heat sealing area of section (b) is relatively weak. As a result, the packaging film 41 will open entirely or at least in large part with almost no remainder, thereby, enabling the opening of the package to occur smoothly and efficiently.

A ninth embodiment of the present invention will now be described with respect to FIGS. 23 and 24. In this example, the tear off notch section 46 is located in the center of the side 44, whereby, the packaging film may be opened in either a left or right direction as shown by the respective "OPEN" arrows.

Bonding strength is also varied in this example. Two (d) sections, each having a bonding strength varying from relatively weak to strong are provided. As described before with section (b), to vary the bonding strength, dot printing is performed on the adhesion surface of the film along section (d), for 10 to 20 mm. from the tear off notch section 46. This dot printing for each (d) section consists of a graduated dot density ranging from 60% to almost 0% further away from the tear off notch section 46.

In this example, since the bonding strength is weak on both left and right sides of the tear off notch section 46, the packaging film is easy to open. Because both sides of the tear off notch section are slightly bonded, no upward curling due to applied heat occurs; however, scratching with a fingernail or other object will easily peel the film and the package can be readily opened. Since the package can be opened in both the left and right direction almost no film will remain on the cassette case.

The invention is not intended to be limited to the graduation of dot density described above. For example, the density of dot printing along either of section (b) or (d), may be varied at fixed intervals in a stepped fashion. In particular, sections (b) and (d) can be divided into three regions of varying dot density, such as, 60%, 40%, and 20%. A linear graduation of dot density may be utilized.

Printed lines may be utilized instead of dots, or in combination with dots, to vary the bonding strength. Other printing patterns, densities and graduations will be readily apparent to one of ordinary skill in the art upon reviewing this disclosure.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A packaging film comprising:

a film of material capable of being formed as a substantially closed film envelope;

tear means formed in said film said tear means including a tear part which is integral with said film and formed at a predetermined location in said film;

a heat sealing area formed in said film, said heat sealing area corresponding to surfaces of the film which overlap during formation of said film envelope and between which a bond, having a predetermined bonding strength, is formed;

at least one tearing portion extending along said heat sealing area from said tear part of said tear means; and means for modifying the bonding strength between the overlapping surfaces of said film along a predetermined length of said at least one tearing portion and for causing the bonding strength to gradually increase along said predetermined length away from the tear part of said tear means, from a minimum bonding strength, greater than or equal to zero, to said predetermined bonding strength.

2. A packaging film according to claim 1, wherein, said tear part of said tear means comprises an edge of a peel section in said film;

said peel section being connected to said tearing portion of said heat sealing area; and said bonding strength between overlapping surfaces of said film at said peel section being less than the bonding strength of said tearing portion, whereby, said peel section curls when heat is applied allowing a user to grasp said peel section.

3. A packaging film according to claim 1, wherein, said tear part of said tear means comprises two peel sections forming a concave notch in said film;

said heat sealing area includes two tearing portions, each tearing portion being connected at one end to a respective peel section; and said bonding strength between overlapping surfaces of said film at each of said peel sections being less than that at said tearing portions, whereby, each peel section curls when heat is applied to allow a user to grasp said peel section.

4. A packaging film according to claim 1, wherein, said tear part of said tear means comprises an edge of said film at one end of said tearing portion of said heat sealing area.

5. A packaging film according to claim 1, wherein, said tear part of said tear means comprises a concave notch in said film; and said heat sealing area includes two tearing portions, such tearing portion being connected at one end to opposing sides of said concave notch.

6. A packaging film according to claim 1, wherein said bonding strength modifying means causes said bonding strength along said predetermined length of said tearing portion of said heat sealing area to increase progressively.

7. A packaging film according to claim 1, wherein said bonding strength modifying means cause said boding strength along said predetermined length of said tearing portion of said heat sealing area to increase incrementally at fixed intervals.

8. A packaging film according to claim 1, wherein said bonding strength modifying means comprises printed areas which vary in density along said predetermined length of said tearing portion away from said tear part, said printed areas causing said bonding strength to vary.

9. A packaging film according to claim 8, wherein, said density of printed areas along said tearing portion, varies from approximately sixty percent near the tear part to approximately zero percent near said heat sealing area at the other end of said tearing portion.

10. A packaging film according to claim 8, wherein, said tearing portion is subdivided into three substantially equal regions, wherein, the region nearest the tear part has a density of printed areas of approximately sixty percent, the middle region has a density of printed areas of approximately forty percent, and the region farthest from the tear part has a density of printed areas of approximately twenty percent.

11. A packaging film according to claim 1, wherein, said film includes printing areas provided with printing ink on areas of at least one surface of said film.

12. A packaging film according to claim 1, wherein, said heat sealing area outside of said tearing portion is substantially unprinted to attain said predetermined bonding strength.

13. A packaging film according to claim 1, wherein said film is formed as a substantially closed film envelope tightly sealed around an article.

14. A packaging film according to claim 13, wherein, said article comprises a cassette case.

15. A packaging film according to claim 14, wherein said tear means is positioned along said film envelope at the center of a side of the cassette case.

16. A packaging film according to claim 1, wherein said tearing means comprises a tearing strip.

17. A packaging film according to claim 16, wherein said film has notches across said heat sealing area between said tearing strip and said tear part.

18. A packaging film according to claim 8, wherein said printed area of said at least one tearing portion comprise at least one of printed dots and lines.

19. A packaging envelope film comprising:

tear means formed in a film of material, said tear means including a tear part which is integral with the film of material and formed at a predetermined location therein;

a heat sealing area formed in the film of material, said heat sealing area corresponding to surfaces of the film of material which overlap during formation of said film envelope and between which a bond, having a predetermined bonding strength, is formed;

at least one tearing portion leading from said tear part of said tear means and extending along said heat sealing area;

means for modifying the bonding strength between the overlapping surfaces of the film of material along said at least one tearing portion and for causing the bonding strength to gradually increase away from the tear part of said tear means from a minimum bonding strength, greater than or equal to zero, to said predetermined bonding strength; and a readily grasped curled peel section formed in the film of material and connected to said tearing portion of said heat sealing area, said bonding strength bonding means modifying the bonding strength between overlapping surfaces of the film of material at said peel section to a level whereat said peel section curls when heat is applied.

20. A packaging film according to claim 2, wherein the application of heat which causes said peel section to curl occurs during a heat shrink process which is applied to the envelope.

* * * * *